US006827150B2

(12) United States Patent
Luke

(10) Patent No.: US 6,827,150 B2
(45) Date of Patent: Dec. 7, 2004

(54) HIGH EXPANSION PACKER

(75) Inventor: Mike A. Luke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 74 days.

(21) Appl. No.: 10/268,007

(22) Filed: Oct. 9, 2002

(65) Prior Publication Data

US 2004/0069502 A1 Apr. 15, 2004

(51) Int. Cl.[7] ..... E21B 33/129

(52) U.S. Cl. ..... 166/387; 166/138; 166/202; 166/216

(58) Field of Search ..... 166/118, 119, 166/138, 202, 212, 216, 382, 387, 217

(56) References Cited

U.S. PATENT DOCUMENTS

| | | | | |
|---|---|---|---|---|
| 2,121,051 A | | 6/1938 | Ragan et al. | |
| 2,306,160 A | | 12/1942 | Freyssinet | 288/6 |
| 2,519,116 A | | 8/1950 | Crake | |
| 2,656,891 A | | 10/1953 | Toelke | |
| 2,751,017 A | | 6/1956 | Baker et al. | 166/216 |
| 2,814,517 A | | 11/1957 | Razdow | 288/20 |
| 3,054,450 A | | 9/1962 | Baker | 166/120 |
| 3,061,013 A | | 10/1962 | Thomas, Jr. | |
| 3,147,016 A | | 9/1964 | Traufler | 277/226 |
| 3,298,440 A | | 1/1967 | Current | 166/123 |
| 3,507,327 A | | 4/1970 | Chenoweth | 166/134 |
| 3,552,492 A | * | 1/1971 | Mullins | 166/237 |
| 3,623,551 A | | 11/1971 | Randermann, Jr. | 166/134 |
| 3,678,998 A | | 7/1972 | Cockrell et al. | 166/123 |
| 3,690,375 A | | 9/1972 | Shillander | 166/187 |
| 4,078,606 A | | 3/1978 | Montgomery | 166/120 |
| 4,146,093 A | | 3/1979 | Horvath et al. | 166/120 |
| 4,153,109 A | | 5/1979 | Szescila | |
| 4,224,987 A | | 9/1980 | Allen | 166/120 |
| 4,253,676 A | | 3/1981 | Baker et al. | 277/34.6 |
| 4,289,200 A | | 9/1981 | Fisher, Jr. | 166/120 |
| 4,300,775 A | | 11/1981 | Ringel | 277/34.3 |
| 4,345,649 A | | 8/1982 | Baugh et al. | 166/120 |

(List continued on next page.)

FOREIGN PATENT DOCUMENTS

| | | | |
|---|---|---|---|
| EP | 0 237 662 A1 | 9/1987 | E21B/34/10 |
| EP | 0 959 226 A2 | 11/1999 | E21B/33/12 |
| EP | 1 116 860 | 7/2001 | |
| FR | 2 586 781 | 6/1987 | F16J/15/34 |
| GB | 1 398 038 | 6/1975 | E21B/33/128 |
| WO | WO 99/05495 | 2/1999 | |

OTHER PUBLICATIONS

EP Search Report, Application No. 03256369.4–1266, dated Feb. 25, 2004.

*Primary Examiner*—Zakiya Walker
(74) *Attorney, Agent, or Firm*—Moser, Patterson & Sheridan

(57) ABSTRACT

The present invention generally relates to a method and apparatus for sealing a tubular. In one aspect, the apparatus is sealing apparatus for a downhole tool such as a bridge plug, packer, or frac-plug. In one embodiment, the present invention provides for a sealing apparatus having a body and a sealing system disposed about the body. The sealing apparatus further includes one or more extrusion rings disposed at each end of the sealing system. The sealing apparatus may also have a first cone to support the one or more extrusion rings and a second cone expandable over the first cone. A slip member is disposed adjacent the second cone at each end of the sealing system. Upon actuation, the sealing apparatus expands the sealing system and causes the slip member to fold outward and engage the tubular. The sealing apparatus is functionally expandable to at least 25% diametrically to seal the tubular.

41 Claims, 8 Drawing Sheets

U.S. PATENT DOCUMENTS 4,353,420 A 10/1982 Miller ..... 166/382
4,375,240 A 3/1983 Baugh et al. ..... 166/387
4,403,660 A 9/1983 Coone ..... 166/387
4,406,469 A 9/1983 Allison ..... 277/123
4,436,150 A 3/1984 Barker ..... 166/131
4,452,463 A 6/1984 Buckner ..... 277/120
4,457,369 A 7/1984 Henderson ..... 166/125
4,487,258 A 12/1984 Jackson et al. ..... 166/120
4,499,947 A 2/1985 Zsoka et al. ..... 166/179
4,540,047 A 9/1985 Akkerman ..... 166/188
4,545,433 A 10/1985 Wambaugh
4,573,537 A 3/1986 Hirasuna et al. ..... 166/387
4,601,498 A 7/1986 Haugen ..... 285/332.3
4,640,351 A 2/1987 Clifton et al. ..... 166/127
4,662,450 A 5/1987 Haugen ..... 166/299
4,674,570 A 6/1987 Jackson ..... 166/187
4,708,202 A 11/1987 Sukup et al. ..... 166/123
4,730,670 A 3/1988 Kim ..... 166/134
4,749,035 A 6/1988 Cassity ..... 166/120
4,753,444 A 6/1988 Jackson et al. ..... 277/230
4,762,179 A 8/1988 Wesson et al. ..... 166/297
4,784,226 A 11/1988 Wyatt ..... 166/376
4,834,175 A 5/1989 Ross et al. ..... 166/120
4,886,117 A 12/1989 Patel ..... 166/187
4,898,239 A 2/1990 Rosenthal ..... 166/133
4,907,651 A 3/1990 Bou-Mikael ..... 166/114
4,913,232 A 4/1990 Cheymol et al. ..... 166/285
5,044,441 A 9/1991 Rubbo et al. ..... 166/382
5,165,703 A 11/1992 Morvant ..... 277/188
5,226,492 A 7/1993 Solaeche P. et al. ..... 166/196
5,271,469 A 12/1993 Brooks et al. ..... 166/387
5,309,993 A 5/1994 Coon et al. ..... 166/115
5,311,938 A 5/1994 Hendrickson et al. ..... 166/134
5,332,038 A 7/1994 Tapp et al. ..... 166/278
5,433,269 A 7/1995 Hendrickson ..... 166/134
5,511,620 A 4/1996 Baugh et al. ..... 166/387
5,542,473 A 8/1996 Pringle
5,605,195 A 2/1997 Eslinger et al. ..... 166/387
5,620,050 A 4/1997 Barbee ..... 166/278
5,636,689 A 6/1997 Rubbo et al. ..... 166/123
5,676,384 A 10/1997 Culpepper ..... 277/188
5,678,635 A 10/1997 Dunlap et al. ..... 166/387
5,711,372 A 1/1998 Stokley ..... 166/187
5,749,585 A 5/1998 Lembcke ..... 277/116.2
5,775,429 A 7/1998 Arizmendi et al. ..... 166/387
5,787,987 A 8/1998 Forsyth et al. ..... 166/313
5,803,178 A 9/1998 Cain ..... 166/306
5,810,082 A 9/1998 Jordan, Jr. ..... 166/120
5,819,846 A 10/1998 Bolt, Jr. ..... 166/123
5,833,001 A 11/1998 Song et al. ..... 166/287
5,875,841 A 3/1999 Wright et al. ..... 166/85.4
5,875,847 A 3/1999 Forsyth ..... 166/313
5,941,313 A 8/1999 Arizmendi ..... 166/387
6,009,951 A 1/2000 Coronado et al. ..... 166/387
6,041,858 A 3/2000 Arizmendi ..... 166/187
6,102,117 A 8/2000 Swor et al. ..... 166/138
6,116,339 A 9/2000 Milne et al. ..... 166/125
6,244,642 B1 6/2001 Serafin et al. ..... 294/86.17
6,318,461 B1 11/2001 Carisella ..... 166/196
2002/0070503 A1 * 6/2002 Zimmerman et al. ..... 277/337

* cited by examiner

1 A-A

6 C-C

6 C-C

6 B-B

HIGH EXPANSION PACKER

BACKGROUND OF THE INVENTION

1. Field of the Invention

The present invention relates to methods and apparatus used in the completion of a well. More particularly, the invention relates to downhole tools. More particularly still, the present invention relates to downhole tools having a sealing and anchoring assembly.

2. Description of the Related Art

Hydrocarbon wells are typically formed with a central wellbore that is supported by steel casing. The casing lines a borehole formed in the earth during the drilling process. An annular area formed between the casing and the borehole is filled with cement to further support the wellbore. Typically, wells are completed by perforating the casing of the wellbore at selected depths where hydrocarbons are found. Hydrocarbons migrate from the formation through the perforations and into the wellbore where they are usually collected in a separate string of production tubing for transportation to the surface of the well.

Downhole tools with sealing systems are placed within the wellbore to isolate producing zones or to direct the flow of production fluids to the surface. Examples of sealing tools include plugs and packers. The sealing tools are usually constructed of cast iron, aluminum, or other drillable alloyed metals. The sealing system includes a sealing element that is typically made of a composite or elastomeric material that seals off an annulus within the wellbore to prevent the passage of fluids. Upon actuation, the sealing element is axially compressed, thereby causing the sealing element to expand radially outward from the tool to sealingly engage a surrounding surface of the tubular. In one example, a bridge plug is placed within the casing to isolate upper and lower sections of production zones. By creating a pressure seal in the wellbore, bridge plugs allow pressurized fluids or solids to treat an isolated formation.

Packers are typically used to seal an annular area formed between two co-axially disposed tubulars within a wellbore. For example, packers may seal an annulus formed between the production tubing and the surrounding wellbore casing. Alternatively, packers may seal an annulus between the outside of a tubular and an unlined borehole. Routine uses of packers include the protection of casing from well and stimulation pressures, and the protection of the wellbore casing from corrosive fluids. Other common uses include the isolation of formations or leaks within a wellbore casing or multiple producing zones, thereby preventing the migration of fluid between zones.

In some applications, it is desirable to install a bridge plug within a large diameter tubular at a point or depth below which a small diameter tubular has previously been installed, e.g., installing a bridge plug in a casing string disposed below a production tubing. In such applications, the sealing element is expanded to a greater distance in order to complete the seal. As a result, the strength of the seal may be compromised and the conventional sealing tool may experience increased failure.

Bridge plugs with inflatable resilient members or bladders were developed to overcome these deficiencies. Inflatable bridge plugs are typically designed with a sufficiently small outside diameter to permit passage through the tubing string and thereafter, when positioned within the larger internal diameter casing, may be inflated to form a sealing bridge plug within the casing. On occasions, the inflatable members or bladders are furnished with anchoring stays designed to grip the internal diameter of the casing and prevent the inflated bladder from movement within the casing. However, under prolonged and cyclic operations within the well, inflatable bridge plugs have tended to fail, sometimes due to a malfunction of their valving systems which maintain the inflation. More commonly, inflatable bridge plugs fail due to failure of the bladder, which commonly results from delamination or puncture of the resilient bladder, thereby causing the bladder to deflate and cease to function as a bridge plug within the casing.

There is a need, therefore, for a sealing apparatus for high expansion applications. There is a further need for a sealing apparatus that may travel through a smaller diameter tubular and seal off a larger diameter tubular.

SUMMARY OF THE INVENTION

The present invention generally relates to a method and apparatus for sealing a tubular. In one aspect, the present invention provides for a sealing apparatus having a body and a sealing system disposed about the body. The sealing apparatus further includes one or more extrusion rings disposed at each end of the sealing system, wherein each of the one or more extrusion rings includes a plurality of slots. Preferably, the slots of each extrusion ring are staggered against the slots of another extrusion ring. The sealing apparatus may also have a cone to support the one or more extrusion rings and urge a slip member outward. The slip member is disposed adjacent the cone at each end of the sealing system. Upon actuation, the sealing apparatus expands the sealing system and causes the slip member to fold outward and engage the tubular.

In another aspect, the sealing system includes one or more sealing elements. In one embodiment, the sealing system has a center seal element, a middle seal element, and an end seal element. Preferably, the seal elements are designed to urge end seal elements outward. Additionally, the middle seal elements is made of a harder material than the end seal elements.

In another aspect still, the sealing apparatus may further include a backup ring disposed between the one or more extrusion rings and the cone. The sealing apparatus may also have an expansion cone disposed between the cone and the slip member. In one embodiment, the expansion cone is connected to the cone using a first shearable member. Also, the slip member is connected to the expansion cone using a second shearable member. Preferably, the first shearable member shears at a lower force than the second shearable member. In this manner, the setting sequence of the sealing apparatus may be controlled.

In another aspect, the present invention provides for a sealing apparatus having a body and a sealing system disposed about the body. The sealing apparatus further includes one or more extrusion rings disposed at each end of the sealing system. The sealing apparatus may also have a first cone to support the one or more extrusion rings and a second cone expandable over the first cone. A slip member is disposed adjacent the second cone at each end of the sealing system. Upon actuation, the sealing apparatus expands the sealing system and causes the slip member to fold outward and engage the tubular.

Aspects of the present invention further provide a method of sealing a tubular. Initially, a tool having a sealing member disposed about a body is run into a tubular. The tool may also have an extrusion ring disposed adjacent each end of the sealing member and a cone disposed adjacent each extrusion ring. Each end of the tool has a slip member for anchoring the sealing system. After the tool in disposed at the desired depth of the tubular, a force is applied to the slip member at one end of the tool. The force causes the sealing member to expand into contact with an area of the tubular, the extrusion ring to fold outward and plastically deform, and the slip member to expand and engage the tubular. Preferably, the sealing member, extrusion ring, and the slip member are set in a predetermined sequence.

In another aspect, the expansion packer is capable of expanding at least 15% diametrically to seal a tubular.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
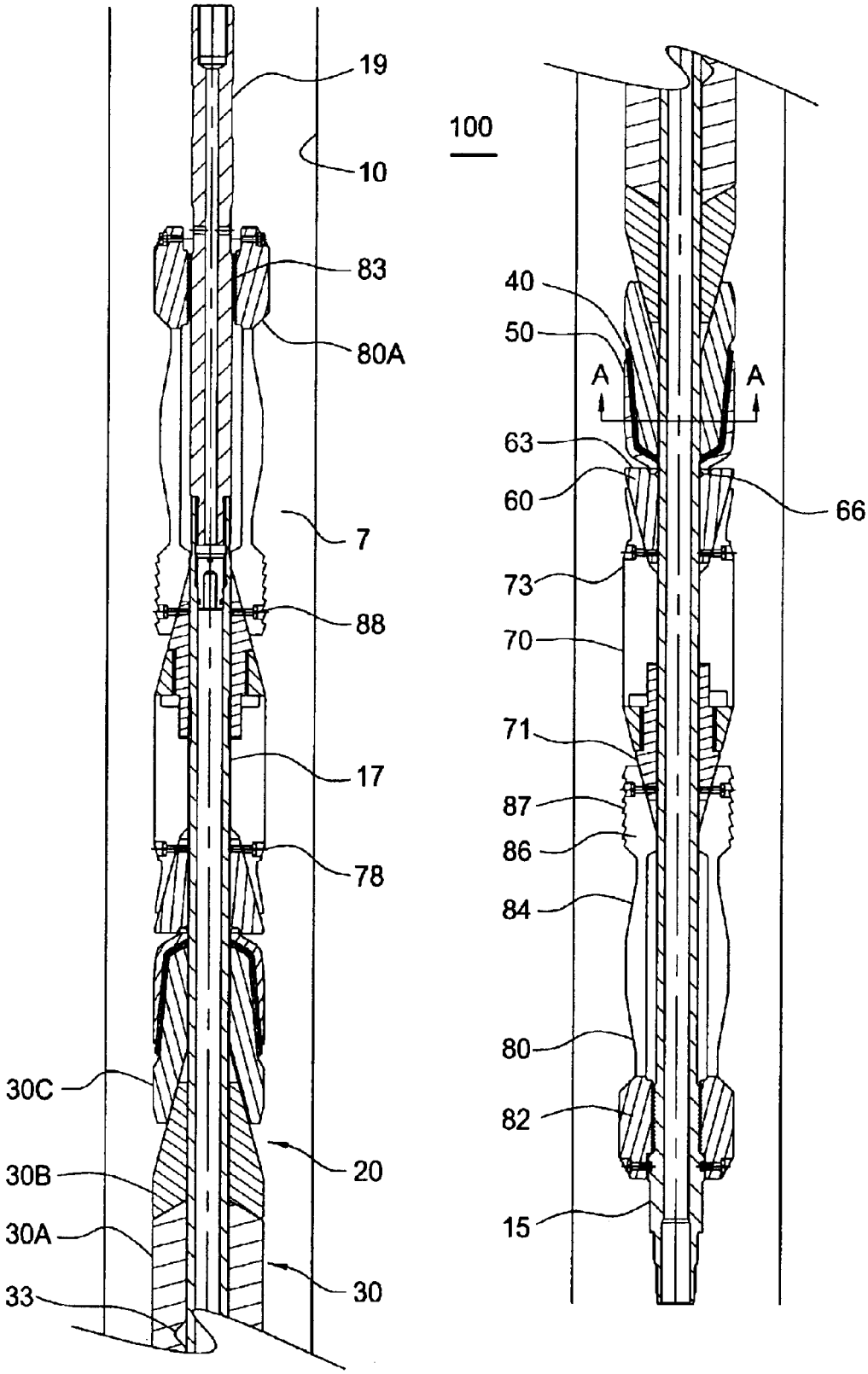
FIG. 1 is a cross-sectional view of a sealing apparatus according to aspects of the present invention.

FIG. 1 presents a cross-section view of one embodiment of a sealing apparatus 100 according to aspects of the present invention. The sealing apparatus 100 is disposed within a string of casing 10 and shown as a bridge plug. However, it should be noted that the sealing apparatus 100 may also be a packer, a frac-plug, or any other device used to seal off a tubular or a wellbore.

The sealing apparatus 100 comprises a mandrel 15 or body that acts as a center support member for the apparatus 100. The apparatus 100 also includes a sealing and anchoring assembly 20 disposed on the mandrel 15. The sealing and anchoring assembly 20 has two main functions. First, the sealing and anchoring assembly 20 acts as a sealing device to seal off a portion of the casing 10. Second, the sealing and anchoring assembly 20 acts as an anchoring device to secure the sealing apparatus 100 within the string of casing 10.

The mandrel 15 of the sealing apparatus 100 defines an elongated tubular body. In the preferred embodiment, the mandrel 15 is made from a soft alloy material. The soft-alloy characteristics allow the mandrel 15 to be "drilled up" quickly during the milling operation in the removal of the apparatus 100 from the casing 10. However, a non-metallic mandrel may also be employed, so long as it is capable of supporting the weight the sealing and anchoring assembly 20. Additionally, the mandrel 15 may be hollow or solid depending on the application. For example, if the sealing system 30 is used as a packer, the mandrel 15 will be hollow. Conversely, if the sealing system 30 is used as a bridge-plug, the mandrel 15 will be solid as illustrated on FIG. 1. In one embodiment, teeth 17 are formed on an outer surface of the mandrel 15 for mating with one or more components of the sealing and anchoring assembly 20. For employment in larger inner diameter tubulars, the sealing apparatus 100 may include an extension mandrel 19 temporarily connected to the mandrel 15. After the sealing and anchoring assembly 20 is set, the extension mandrel 19 may detach from the mandrel 15 and be removed.

As shown on FIG. 1, the sealing and anchoring assembly 20 includes several components. The components may be fabricated from either metallic or non-metallic materials. In the preferred embodiment, the sealing and anchoring assembly 20 includes a non-metallic sealing system 30 that is capable of sealing an annulus 7 in harsh environments. Preferably, the sealing system 30 is made of a composite or elastomeric material and may have any number of configurations to effectively seal the annulus 7 within the casing 10. For example, the sealing system 30 may include grooves, ridges, indentations, or protrusions designed to allow the sealing system 30 to conform to variations in the shape of the interior of the surrounding casing 10. Preferably, the sealing system 30 is capable of withstanding temperatures up to about 350° F., very high or low pH environments, or pressure differentials up to about 10,000 psi.

Figure 6:
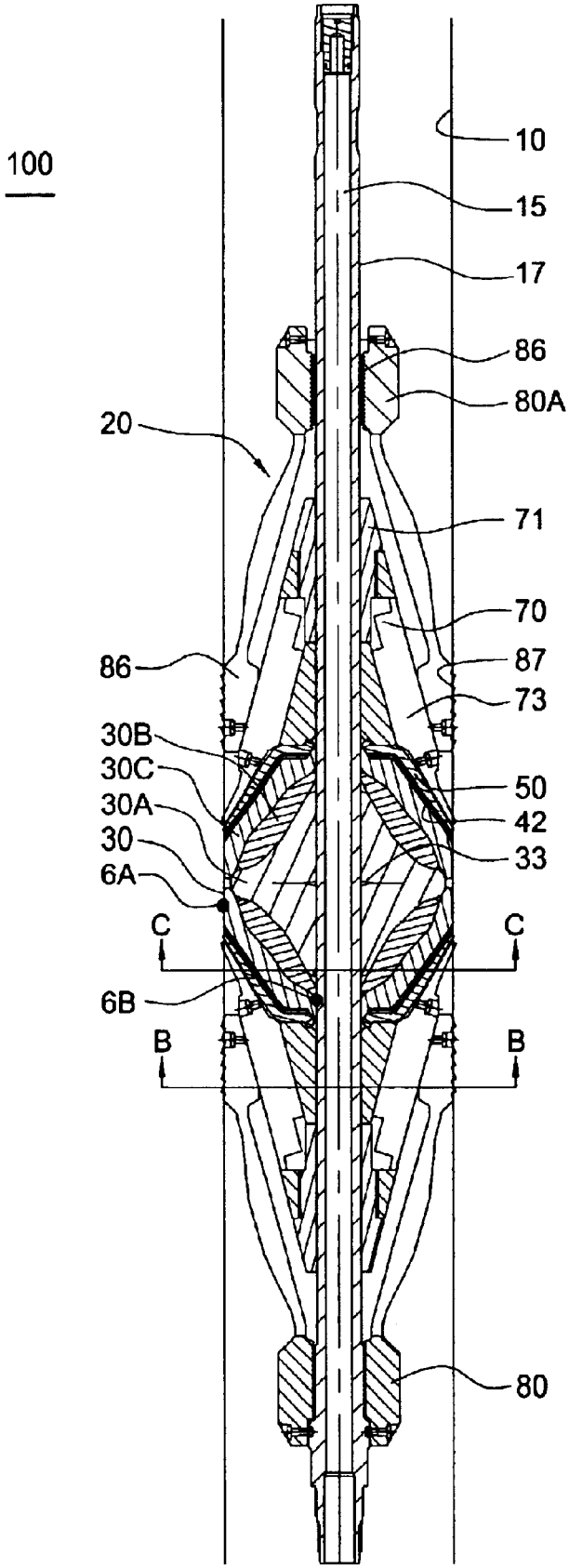
FIG. 6 is a cross-sectional view of the sealing apparatus of FIG. 1 after expansion.

In one embodiment, the sealing system 30 includes a center seal element 30A disposed about the body 15. The center seal element 30A may be formed with a groove around the interior surface to facilitate the radial expansion of the center seal element 30A under compression. The sealing system 30 may further include a middle seal element 30B disposed adjacent each end of the center seal element 30A and an end seal element 30C disposed adjacent each middle seal element 30B. This configuration of the sealing system 30 allows the sealing system 30 to set with a relatively low axial force applied. Preferably, the contact surfaces between the center, middle, and end seal elements 30A, 30B, 30C are designed to help the seal elements 30A, 30B, 30C to slide under each other during actuation. For example, the contact surface between the middle seal element 30B and the end seal element 30C may be angled, thereby allowing the middle seal element 30B to cam the end seal element 30C outward. Further, the middle seal elements 30B may be formed of a harder material than the end seal elements 30C, thereby making it easier for the middle seal elements 30B to slider under the softer end seal elements 30C. The center seal element 30A is primarily intended to function as a filler and provide additional elasticity for maintaining setting force on the end sealing elements 30C. Upon actuation, the seal elements 30A, 30B, 30C slide under each other and fold outwardly toward the casing 10. FIG. 6 is a cross-sectional view of the sealing apparatus 100 after expansion. As seen in FIG. 6, the expanded seal elements 30A, 30B, 30C form a bi-directional, self-energizing cup type seal system. In this respect, pressure points such as 6A and 6B act like a wedge to assist the anchoring of the sealing system 30 in the casing 10.

Figure 2:
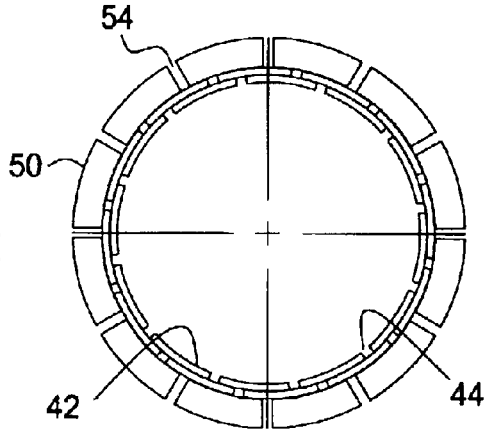
FIG. 2 is a cross-sectional view of the sealing apparatus along line A—A of FIG. 1.
Figure 3:
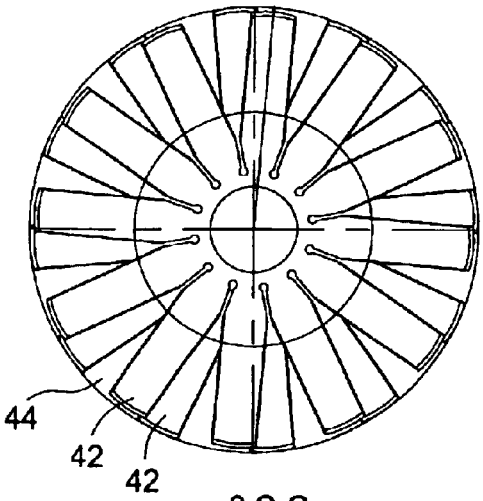
FIG. 3 is a cross-sectional view of the extrusion rings and backup rings along line C—C of FIG. 6.

The sealing and anchoring assembly 20 further includes an anti-extrusion system 40 disposed adjacent each side of the sealing system 30. In one embodiment, the anti-extrusion system 40 may consist of a plurality of stacked slotted extrusion rings 42 as shown in FIGS. 1 and 2. Each ring 42 is an annular cup-shaped member at least partially surrounding a portion of the sealing system 30. The rings 42 are positioned such that the slots 44 of each ring 42 are staggered relative to another ring 42. The number of rings 42 and the number of slots 44 in each ring 42 may be determined by the size of the annulus 7 to be sealed. When the slots 44 are staggered, the extrusion rings 42 are allowed to fold outward without creating an opening for the seal elements 30A, 30B, 30C to extrude through. FIG. 2 depicts the staggered rings 42 before expansion. FIG. 3 depicts the staggered rings 42 after they have been expanded outward.

The anti-extrusion system 40 is supported by one or more backup rings 50. Each backup ring 50 is a slotted annular member disposed about the body 15 adjacent the extrusion rings 42. Preferably, the slots 54 of each backup ring 50 are staggered relative to the extrusion rings 42. The backup rings 50 are designed to fold outward upon expansion. As shown in FIG. 2, the backup ring 50 may have a thicker cross-sectional area to provide support for the extrusion rings 42.

Figure 15:
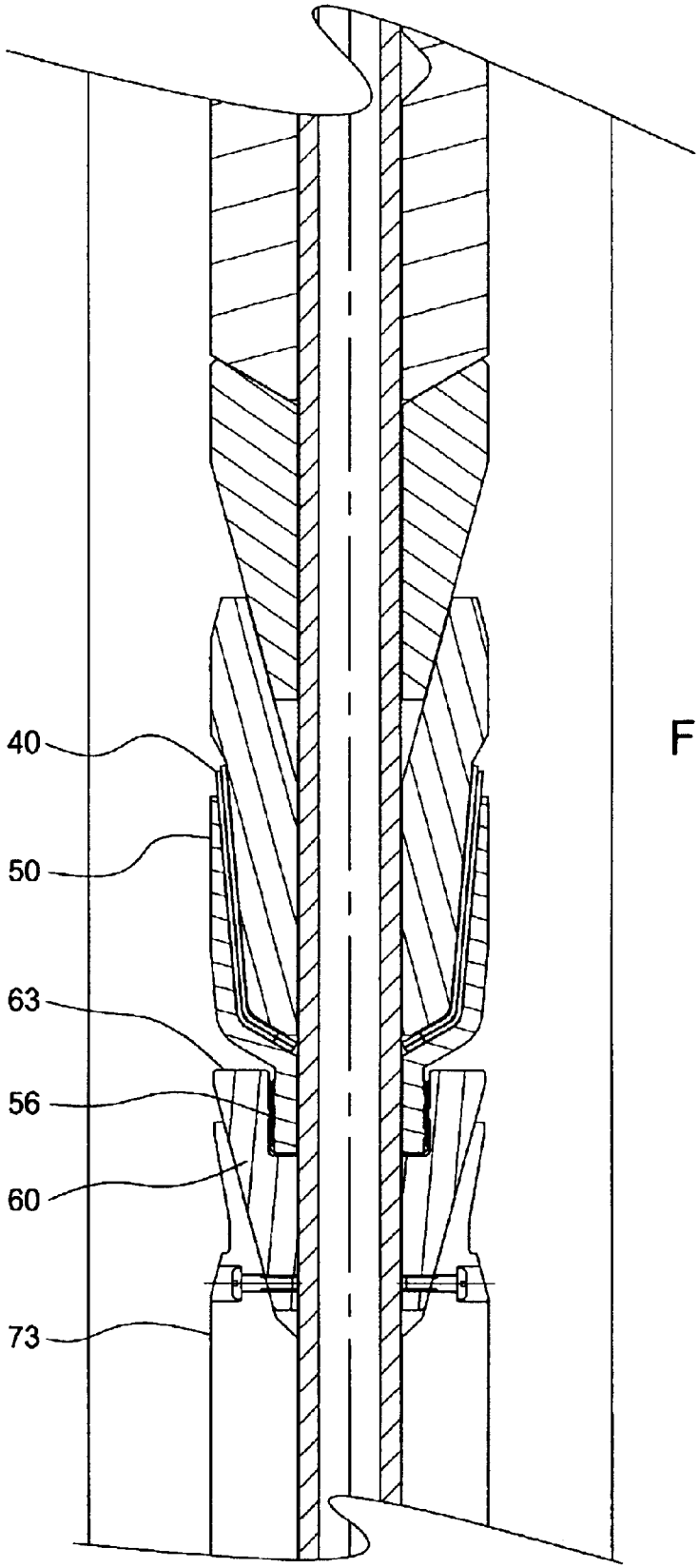
FIG. 15 is a partial view of another embodiment of a sealing apparatus according to aspects of the present invention.

The sealing and anchoring assembly 20 further includes a solid cylindrical cone 60 disposed adjacent the backup rings 50. The cone 60 is positioned such that the wider portion 63 of the cone 60 is closer to the backup rings 50. In this position, the cone 60 may serve two main functions. First, the cone 60 provides a pivot point for the backup ring 50 and acts a back support for the backup ring 50 after expansion. In one embodiment, a seat 66 is formed around the pivoting surface of the cone 60 for mating with the backup ring 50. Second, the cone 60 may also serve as a cam to force one or more expansion fingers 73 of a high expansion cone 70 outward until the expansion fingers 73 contact the casing 10. In another embodiment, the cone 60 may be attached to a threaded portion 56 of the backup ring 50 using a threaded connection as illustrated in FIG. 15.

The high expansion cone 70 is a slotted cone having a base 71 and one or more expansion fingers 73 formed between the slots 76. Preferably, each finger 73 attaches to the base 71 at a relatively small cross-sectional area, which provides more flexibility for the finger 73 to fold outward during expansion. A portion of the free end of the fingers 73 is tapered to complement the incline of the solid cone 60. Upon expansion, the base 71 is urged closer to the solid cone 60 and the fingers 73 slide over the incline surface of the cone 73. In this manner, the fingers 73 are forced outward toward the casing 10 and plastically deformed. The expanded high expansion cone 70 provides additional anchoring support for the sealing system 30 in larger diameter casings. Preferably, a first shearable member 78 is used to connect each finger 73 of the high expansion cone 70 to the solid cone 60. An example of the shearable member 78 may include a shearable screw designed to shear at a predetermined force. The shearable member 78 prevents the accidental or premature setting of the high expansion cone 70.

The sealing and anchoring assembly 20 may further include one or more slip members 80. In one embodiment, each slip 80 has a base portion 82, an arm portion 84, and a slip portion 86 as illustrated in FIG. 1. The slip portion 86 includes an outer surface having at least one outwardly extending serration 87 or edged tooth to engage the casing 10. An inner surface of the slip portion 86 may be tapered to complement the outer surface of the base 71 of the high expansion cone 70. The slip portion 86 may be attached to the high expansion cone 70 using a second shearable member 88. Preferably, the second shearable member 88 shears at a higher shearing force than the first shearable member 78. As a result, the high expansion cone will actuate before the slip member. In this manner, the setting sequence of the sealing apparatus 100 may be controlled.

The arm portion 84 is designed to provide flexibility between the slip portion 86 and the base portion 82. In this respect, the slip portion 86 is allowed to fold outward as it slides along the incline of the high expansion cone 70 while the base portion 82 remains in contact with the mandrel 15. As illustrated in FIG. 1, the slips 80 at one end of the sealing apparatus 100 are fixed against the mandrel 15. The slips 80 may be attached to the mandrel 15 using threads, screws, or combinations thereof. On the other hand, slips 80A disposed at the other end of the sealing apparatus 100 are movable relative to the mandrel 15. The movable slips 80A may include one or more teeth 83 formed on the surface contacting the mandrel 15. These teeth 83 engage the teeth 17 of the mandrel 15 to provide one way movement of the movable slips 80A. During the run-in of the sealing apparatus 100, the movable slips 80A may be temporarily connected to the mandrel 15 using a shearable member (not shown) to prevent accidental or premature setting of the sealing system 20.

In operation, the sealing apparatus 100 is run into the casing 10 to the desired depth of the wellbore. As shown in FIG. 1, the sealing apparatus 100 includes an extension mandrel 19 attached to the body 15 to accommodate the sealing and anchoring assembly 20. Then a setting tool (not shown) is run-in on tubing or electric line to actuate the sealing apparatus 100. Upon application of an axial force, the movably disposed slips 80A are urged toward the fixed slips 80. The initial setting sequence begins with the sealing system 30 folding outward toward the casing 10. Preferably, the center seal element 30A fold outward at the groove 33 and cam the middle seal element 30B outward, which, in turn, cams the end seal element 30C outward as shown FIG. 6.

Figure 4:
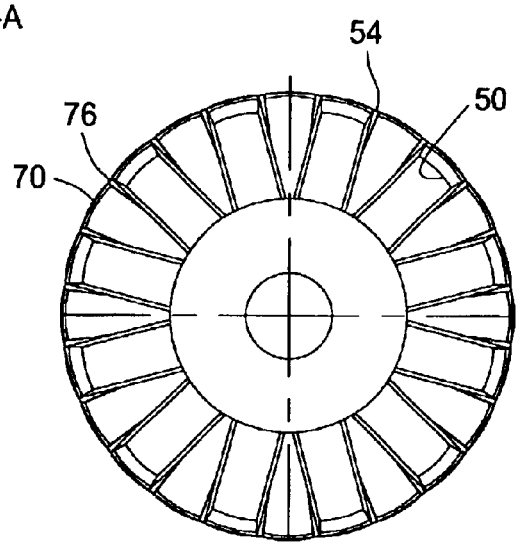
FIG. 4 is a cross-sectional view of the high expansion cone and the backup rings along line C—C of FIG. 6.

Thereafter, the extrusion rings 42 and the backup rings 50 pivot about the seat 66 and fold outward. Because the slots 44, 54 of the extrusion rings 42 and the backup rings 50 are staggered as illustrated in FIGS. 3 and 4, the rings 42, 50 prevent the seal elements 30A, 30B, 30C from extruding through. Particularly, FIG. 3 shows a cross-sectional view of two staggered extrusion rings 42 after expansion. FIG. 4 shows a cross-sectional view of the backup ring 50 and the high expansion cone 70 after expansion. As shown, the backup ring 50 is positioned to fill the void between the two staggered extrusion rings 42. Alternatively, one or more extrusion rings 42 may be added to fill the void. The expanded seal element configuration forms a bi-directional, self-energizing cup type seal system. Specifically, pressure points 6A and 6B act like a wedge to help anchor the sealing apparatus 100 in the casing 10.

Figure 5:
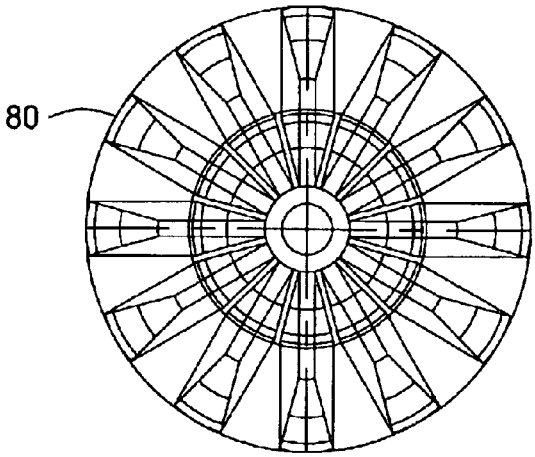
FIG. 5 is a cross-sectional view of the slips along line B—B of FIG. 6.

As more force is applied, the first shearable member 78 is sheared, thereby allowing the fingers 73 of the high expansion cone 70 to slide over the solid cone 71. The high expansion cones 70 provide additional anchoring support for the sealing apparatus 100. Finally, the second shearable member is sheared, thereby allowing the slip members 80 to slide over the base 71 of the high expansion cone 70. FIG. 5 is a cross-sectional view of the slips along line B—B of FIG. 6. As shown in FIG. 6, the slip portion 86 of the slip member 80 is wedged between the finger 73 of the high expansion cone 70 and the casing 10 after the sealing apparatus 100 is set. In this position, the serrations 87 of the slip portion 86 engage and frictionally contact the casing 10 to provide anchoring support. Further, the teeth 83 of the movable slip 80A engage the teeth 17 of the body 15 to prevent the sealing and anchoring assembly 20 from disengaging the casing 10. Thereafter, the extension mandrel 19 is released from the body 15 and removed.

Figure 7:
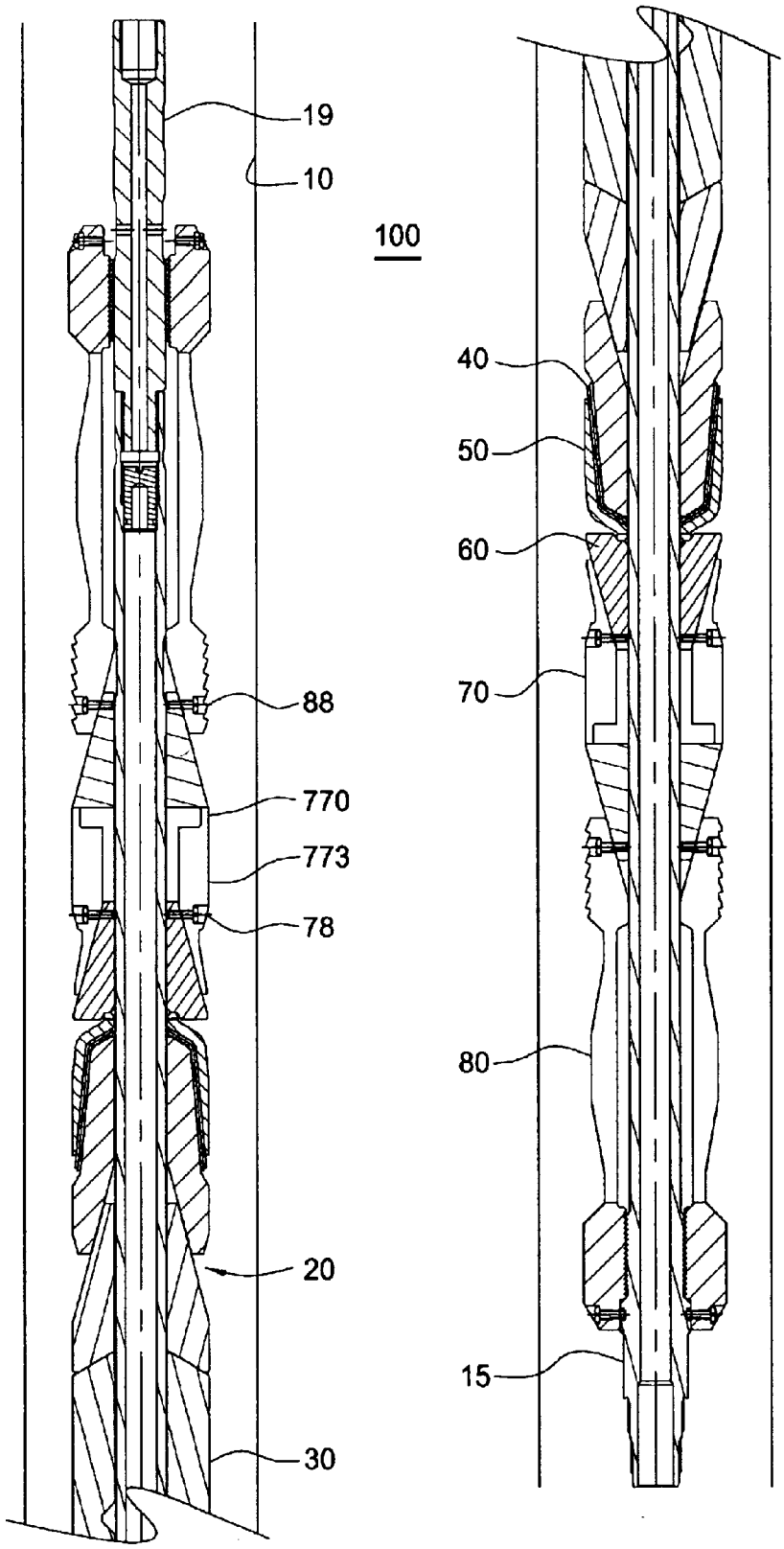
FIG. 7 is a cross-sectional view of another embodiment of the sealing apparatus according to aspects of the present invention.

According to aspects of the present invention, the expansion packer 100 is capable of expanding at least 10% diametrically to seal a tubular 10. Advantageously, the expansion packer 100 may be used to seal a larger inner diameter tubular that is installed below a smaller inner diameter tubular. For example, with respect to the embodiment shown in FIG. 1, the expansion packer 100 may expand at least 90% diametrically to seal the tubular 10. With respect to the embodiment shown in FIG. 7, the expansion packer 100 may expand at least 60% diametrically to seal the tubular 10. With respect to the embodiment shown in FIG. 8, the expansion packer 100 may expand at least 30% diametrically to seal the tubular 10. It must be noted that the above recited percentages of expansion are given as examples only, and are not intended to limit the aspects of the present invention. Depending on the need, the expansion packer 100 may be designed to expand at least 20%, 25%, or 33% diametrically to seal a tubular 10.

In another aspect, the sealing apparatus 100 may also be used in a smaller inner diameter casing. For example, the sealing apparatus 700 shown in FIG. 7 may be used to seal a casing having an inner diameter between 5.5 inches and 7 inches. As shown, the medium expansion cone 770 has a shorter finger 773 than the high expansion cone 70 shown in FIG. 1. Further, the radial width of the fingers 773 of the medium expansion cone 770 is smaller than the radial width of the finger 73 of the high expansion cone 70. The smaller radial width provides clearance between the finger 773 and the casing for the slips 80 to cam outward and engage the casing.

Figure 8:
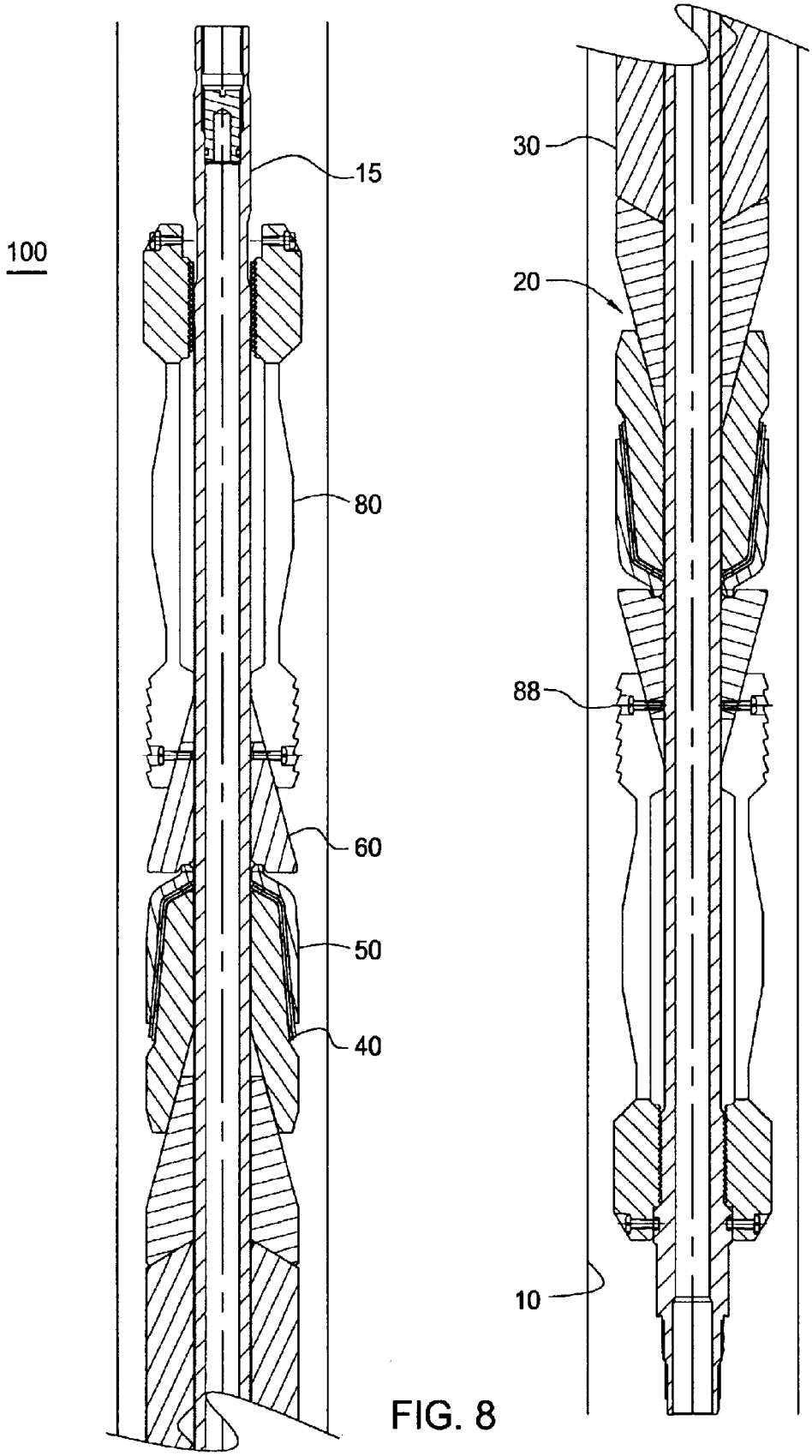
FIG. 8 is a cross-sectional view of another embodiment of the sealing apparatus according to aspects of the present invention.

As illustrated in FIG. 8, the sealing apparatus 800 may be used in smaller diameter tubulars without the medium expansion cone 770. In this respect, the slip members 80 will wedge between the cone 60 and the casing 10. Because the sealing apparatus 100 has fewer components, the extension mandrel 19 is no longer needed to accommodate the sealing and anchoring assembly 20.

Figure 9:
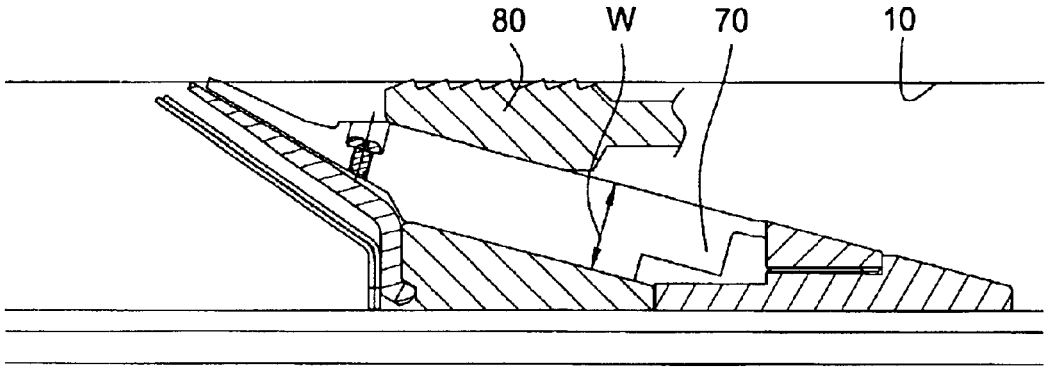
FIGS. 9–14 are a partial cross-sectional view of different embodiments of the sealing apparatus after expansion.
Figure 10:
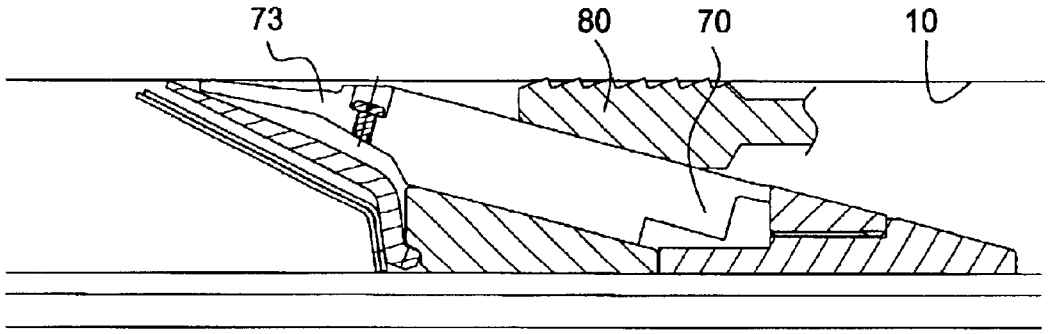

FIGS. 9–14 shows a partial cross-sectional view of different embodiments of the sealing apparatus 100 after expansion in different sized tubulars. Specifically, the inner diameters of the tubulars decrease from FIG. 9 to FIG. 14. In FIGS. 9 and 10, the sealing apparatus is expanded with a high expansion cone 70 in a tubular 10 having an inner diameter of about 7 inches and about 5.875 inches, respectively. Because of the larger inner diameters, the high expansion cone 70 is longer and wider in radial width W than the medium expansion cone 770 of FIGS. 11 and 12. As shown in FIG. 10, the tapered portion of the fingers 73 of the expansion cones 70 may bend against the tubular 10, thereby allowing the slips 80 to cam outward and engage the tubular 10. As a result, each sealing apparatus 100 is applicable for a range of tubular sizes.

Figure 11:
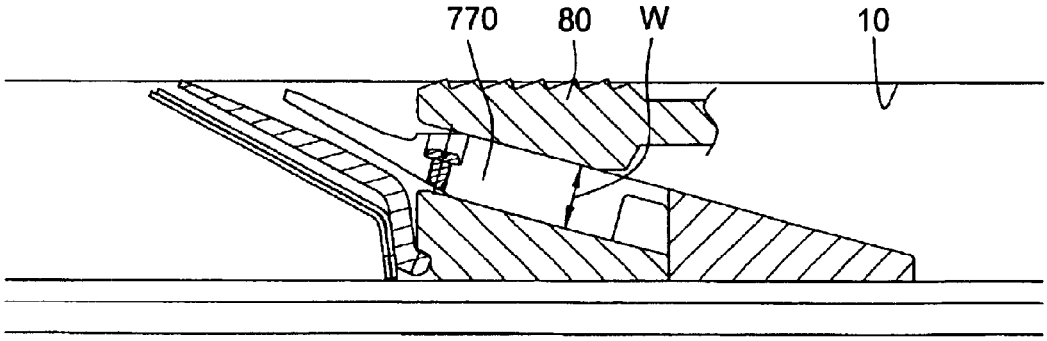
Figure 12:
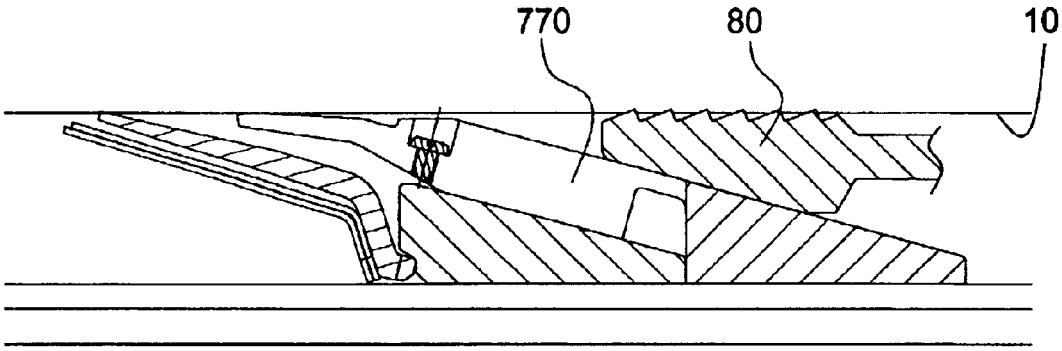

In FIGS. 11 and 12, the sealing apparatus 100 is expanded with medium expansion cones 770 in a tubular 10 having an inner diameter of about 5.75 inches and about 4.75 inches, respectively. The medium expansion cone 770 has a narrower radial width W than the high expansion cone 70. The narrower width W provides clearance between the medium expansion cone 770 and the tubular 10 for the slip member 80 to wedge between.

Figure 13:
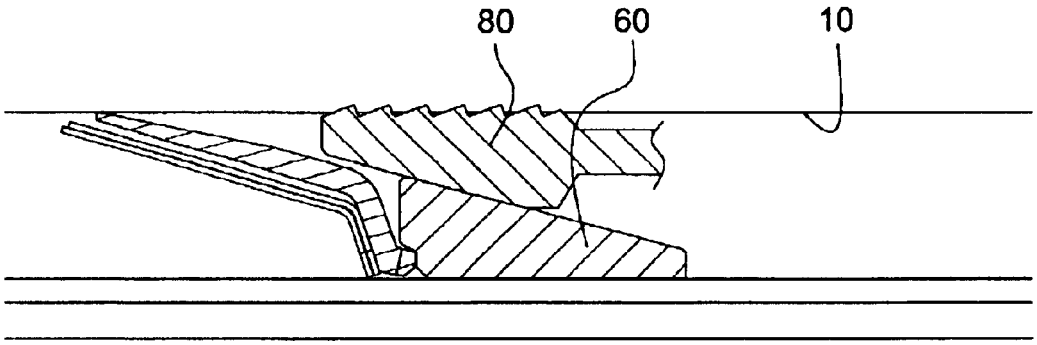
Figure 14:
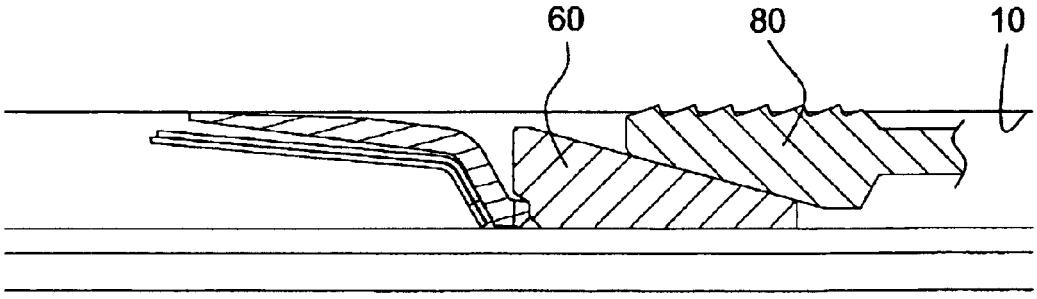

In FIGS. 13 and 14, the sealing apparatus 100 is expanded without any expansion cones in a tubular 10 having an inner diameter of about 4.625 inches and about 3.625 inches, respectively. In the smaller tubulars 10, the slip member 80 may simply wedge between the cone 60 and the tubular 10. Depending on the size of the tubular 10, it may not be necessary for the slip member 80 to move all the way up the cone 60. It must be noted that the size of the tubulars disclosed herein are intended as examples only and not intended to limit the present invention.

While the foregoing is directed to embodiments of the present invention, other and further embodiments of the invention may be devised without departing from the basic scope thereof, and the scope thereof is determined by the claims that follow.

What is claimed is:

1. A sealing apparatus for engaging a tubular, comprising:

a body;

a sealing system disposed about the body;

one or more extrusion rings disposed at each end of the sealing system, wherein the one or more extrusion rings include a plurality of slots;

a cone for supporting the one or more extrusion rings; and a slip member disposed adjacent to the cone at each end of the sealing system, whereby actuating the sealing apparatus expands the sealing system and causes the slip members to fold outward and engage the tubular.

2. The sealing apparatus of claim 1, wherein the sealing system comprises one or more sealing elements.

3. The sealing apparatus of claim 2, wherein the sealing system comprises a center seal element, a middle seal element, and an end seal element.

4. The sealing apparatus of claim 3, wherein the center seal element folds outward and cam the middle seal element outward upon actuation.

5. The sealing apparatus of claim 3, wherein the middle seal element comprises a material that is harder than the end seal element.

6. The sealing apparatus of claim 3, wherein at least one of the seal elements of the sealing system comprises an elastomeric material.

7. The sealing apparatus of claim 1, wherein the plurality of slots are staggered relative to each of the one or more extrusion rings.

8. The sealing apparatus of claim 7, further comprising a backup ring disposed between the one or more extrusion rings and the slip member.

9. The sealing apparatus of claim 8, wherein the backup ring includes a plurality of slots.

10. The sealing apparatus of claim 9, wherein the one or more extrusion rings and the backup ring pivots about a cone.

11. The sealing apparatus of claim 10, wherein the cone cams an expansion member outward.

12. The sealing apparatus of claim 1, wherein the sealing apparatus is functionally expandable to at least 15% diametrically.

13. The sealing apparatus of claim 1, wherein the sealing apparatus is functionally expandable to at least 20% diametrically.

14. The sealing apparatus of claim 1, wherein the sealing apparatus is functionally expandable to at least 25% diametrically.

15. The sealing apparatus of claim 1, wherein the sealing apparatus is functionally expandable to at least 33% diametrically.

16. A sealing apparatus for engaging a tubular, comprising:

a body;

a sealing system disposed about the body;

one or more extrusion rings disposed at each end of the sealing system;

a first cone for supporting the one or more extrusion rings;

a second cone expandable over the first cone; and a slip member disposed adjacent to the cone at each end of the sealing system, whereby actuating the sealing apparatus expands the sealing system and causes the slip members to fold outward and engage the tubular.

17. The sealing apparatus of claim 16, wherein the expansion member includes a finger attached to a base, wherein the finger is expandable toward the tubular.

18. The sealing apparatus of claim 16, wherein the sealing system comprises one or more sealing elements.

19. The sealing apparatus of claim 18, wherein at least one of the one or more seal elements comprises an elastomeric material.

20. The sealing apparatus of claim 16, further comprising a backup ring disposed between the one or more extrusion rings and the first cone.

21. The sealing apparatus of claim 20, wherein the backup ring is connected to the first cone.

22. The sealing apparatus of claim 16, wherein the second cone is connected to the first cone using a first shearable member.

23. The sealing apparatus of claim 22, wherein the slip member is connected to the second cone using a second shearable member.

24. The sealing apparatus of claim 23, wherein the first shearable member shears at a lower force than the second shearable member.

25. The sealing apparatus of claim 16, wherein the one or more extrusion rings comprises a plurality of slots.

26. The sealing apparatus of claim 25, wherein the plurality of slots are staggered relative to each of the one or more extrusion rings.

27. A method of sealing a tubular, comprising:

running a tool into the tubular, the tool comprising:

a body;

a sealing system disposed about the body;

a slotted extrusion ring disposed adjacent each end of the sealing system;

a cone disposed adjacent each slotted extrusion ring; and a slip member disposed adjacent each cone;

applying a force to the slip member at one end of the tool;

expanding the sealing system into contact with an area of the tubular;

causing the slotted extrusion ring to fold outward and plastically deform; and causing the slip member to engage the tubular, wherein the sealing member, extrusion ring, and the slip member are set in a predetermined sequence.

28. The method of claim 27, wherein the tool further comprises an expansion member disposed between the cone and the slip member.

29. The method of claim 27, wherein the slip member includes a serrated portion for frictional engagement with the tubular.

30. The method of claim 27, wherein sealing system comprises a plurality of seal elements.

31. The method of claim 27, wherein the sealing system is expanded to at least 15% diametrically.

32. The method of claim 27, wherein the sealing system is expanded to at least 20% diametrically.

33. The method of claim 27, wherein the sealing system is expanded to at least 25% diametrically.

34. The method of claim 27, wherein the sealing system is expanded to at least 44% diametrically.

35. A slip and cone assembly functionally expandable to at least 25% diametrically.

36. A sealing apparatus for engaging a tubular, comprising:

a body;

a sealing system disposed about the body;

one or more extrusion rings disposed at each end of the sealing system;

a cone for supporting the one or more extrusion rings;

a slip member disposed adjacent to the cone at each end of the sealing system, whereby actuating the sealing apparatus expands the sealing system and causes the slip members to fold outward and engage the tubular.

a backup ring disposed between the one or more extrusion rings and the cone; and an expansion member disposed between the cone and the slip member, wherein the expansion member is connected to the cone using a first shearable member and the slip member is connected to the expansion member using a second shearable member.

37. The sealing apparatus of claim 36, wherein the first shearable member shears at a lower force than the second shearable member.

38. A sealing apparatus for engaging a tubular, comprising:

a body;

a sealing system disposed about the body;

one or more extrusion rings disposed at each end of the sealing system;

a cone for supporting the one or more extrusion rings; and a first slip member disposed adjacent to the cone at one end of the sealing system and a second slip disposed adjacent to another cone at the other end thereof, the first slip member is substantially fixed against the body and the second slip member is movable relative to the body, whereby actuating the sealing apparatus expands the sealing system and causes the slip members to fold outward and engage the tubular.

39. The sealing apparatus of claim 38, wherein the second slip member has teeth that engage one or more teeth formed on the body to provide one way movement of the second slip member.

40. A method of sealing a tubular, comprising:

running a tool into the tubular, the tool comprising:

a body;

a sealing system disposed about the body;

an extrusion ring disposed adjacent each end of the sealing system;

a cone disposed adjacent each extrusion ring; and a slip member disposed adjacent each cone;

applying a force to the slip member at one end of the tool;

expanding the sealing system into contact with an area of the tubular, wherein the expanded sealing system provides a bi-directional, self-energizing cup type seal system;

causing the extrusion ring to fold outward and plastically deform; and causing the slip member to engage the tubular, wherein the sealing member, extrusion ring, and the slip member are set in a predetermined sequence.

41. The method of claim 30, wherein the slotted extrusion ring folds outward without creating an opening for the plurality of sealing elements to extrude there though.

* * * * *